US006276893B1

(12) United States Patent
Plüschow et al.

(10) Patent No.: US 6,276,893 B1
(45) Date of Patent: Aug. 21, 2001

(54) FOLDED BOX HOPPER IN A PACKAGING MACHINE

(75) Inventors: Dieter Plüschow; Bernd Hähnel, both of Stutensee (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 0 days.

(21) Appl. No.: 09/416,766

(22) Filed: Oct. 12, 1999

(30) Foreign Application Priority Data

Oct. 27, 1998 (DE) ..... 198 49 406

(51) Int. Cl.[7] ..... B65G 59/06

(52) U.S. Cl. ..... 414/797.8; 271/157; 414/795.8; 493/315

(58) Field of Search ..... 271/157; 414/795.8, 414/798.9, 736, 737; 493/315, 316, 317

(56) References Cited

U.S. PATENT DOCUMENTS

| | | | |
|---|---|---|---|
| 2,918,279 | 12/1959 | Jackson . | |
| 3,429,570 | 2/1969 | Scully . | |
| 3,914,919 | 10/1975 | Boissy et al. . | |
| 5,547,336 * | 8/1996 | Whiteman | 414/798.9 |
| 5,588,643 | 12/1996 | Tagliaferri et al. . | |
| 5,813,965 * | 9/1998 | Mitchell et al. | 493/315 |

FOREIGN PATENT DOCUMENTS

| | | |
|---|---|---|
| 43 14 696 | 11/1994 | (DE) . |
| 695 00 361 | 11/1995 | (DE) . |
| 2 478 576 | 9/1981 | (FR) . |

* cited by examiner

*Primary Examiner*—Janice L. Krizek
(74) *Attorney, Agent, or Firm*—Paul Vincent

(57) ABSTRACT

A folded box hopper in a packaging machine comprises a hopper shaft accepting a stack of flattened folded boxes as well as a transfer device having a gripper by means of which the lowermost folded box of the stack can be removed from the hopper shaft, and having an input belt for introducing the folded boxes into the hopper shaft. A first adjustment device serves for adjusting the height of the gripper and of the hopper shaft relative to a downstream transport belt and a second adjustment device is provided for aligning the hopper shaft relative to the gripper, wherein the height and/or tilt of the input belt can be changed. A simple adjustment of the input belt is effected in that the input belt is borne at the hopper shaft in a hinged fashion via a first bearing at its front end proximate the hopper shaft and is borne, via a second bearing proximate its rear end to follow a control path. The control path can thereby be defined by a pendulous support.

7 Claims, 2 Drawing Sheets

FOLDED BOX HOPPER IN A PACKAGING MACHINE

This application claims Paris Convention Priority of DE 198 49 406.8 filed Oct. 27, 1998 the complete disclosure of which is hereby incorporated by reference.

BACKGROUND OF THE INVENTION

The invention concerns a folded box hopper in a packaging machine having a hopper shaft accepting a stack of folded boxes, a transfer device having a gripper for removing the lowermost folded box of the stack from the hopper shaft and an input belt for introducing the folded boxes into the hopper shaft, having a first adjustment device for height adjustment of the gripper and the hopper shaft relative to a downstream transport belt as well as a second adjustment device for the alignment of the hopper shaft relative to the gripper, wherein a height and/or tilt of the input belt can be changed.

During operation of a packaging machine, the initially flat, collapsed folded boxes must be erected and fed to the actual packaging unit. Towards this end, an input belt introduces folded boxes to a hopper shaft, the hopper shaft constituting an intermediate storage instrument and is normally tilted in a diagonally downward direction, the folded boxes being accepted in the hopper shaft in a stacked fashion. The lower side of the hopper shaft is open so that the lowermost folded box of the stack can be accessed and removed from the hopper shaft using a gripper. The gripper is part of a circulating transfer device which simultaneously erects the folded boxes and deposits them on a downstream transport device, normally the so-called folded box chain.

A reliable functioning of the folded box hopper and of the transfer device depends substantially on the precise mutual adjustment of the dimensioning and positioning of the individual components in dependence on the format of the folded box being processed. Since a packaging machine must process folded boxes having differing formats, the relative configuration of the individual components must be adjusted in the event of a format change. Towards this end, prior art has vertically aligned the transfer device together with the hopper shaft relative to the downstream folded box chain and also adjusted the hopper shaft relative to the removal position of the transfer device gripper. In addition, the width of the hopper shaft can be adjusted to the width of the folded-together boxes. Displacement of the transfer device and of the hopper shaft necessitates new positioning of the input belt. This is usually done with a plurality of transmission elements, wherein the input belt can be adjusted in height both at its front end facing the hopper shaft as well as at its rear end and can be shifted towards and away from the hopper shaft. This plurality of adjustment motion at both ends of the input belt is tedious so that a format change consumes a substantial amount of time. Furthermore the structural difficulty associated with the input belt adjustment devices is rather significant and therefore expensive.

It is the underlying purpose of the invention to create a folded box shaft of the above mentioned kind with which the input belt can be adjusted during a format change in a simple and rapid fashion.

SUMMARY OF THE INVENTION

This purpose is achieved in accordance with the invention with a folded box shaft in that the input belt is borne for pivoting on the hopper shaft at its front end proximate thereto via a first bearing and is borne by a second bearing proximate its rear end to move through a control path.

In accordance with the invention, the input belt does not have its own, individual adjustment unit rather adjustment of the input belt is coupled to the adjustment motion of the transfer device and/or of the gripper as well as of the hopper shaft as effect by the first and the second adjustment devices. Towards this end, the input belt is borne for pivoting at its front end in the first bearing either directly or indirectly on the hopper shaft. When the hopper shaft experiences a vertical and/or horizontal shift via the adjustment motion of the first and the second adjustment devices, the first bearing of the input belt is correspondingly shifted. This leads to an associated shifting in the horizontal and/or vertical direction of the rear end of the input belt. Since the rear end of the input belt is guided by the second bearing along a control path, each position of the first bearing is associated with a unique position of the second bearing so that a suitable adjustment of the input belt can be defined within the possible adjustment range of the first and the second adjustment devices. In this manner, the input belt automatically assumes a suitable position when the first and/or second adjustment device are activated. Separate drive or adjustment units are therefore not necessary for the input belt and the structural difficulty and the expense can be kept low.

Alignment of the input belt in the individual positions is literally defined by the control path acting on the second bearing. One advantageously provides that the input belt is likewise borne in a hinged fashion at its second bearing for shifting horizontally and vertically along the control path. Towards this end, the control path should be configured in such a fashion that the input belt is either directed horizontally or slightly tilted downwardly in the transport direction.

A control path having a circular arc shape can be effected in a simple fashion when the pivoting second bearing is disposed at one end of a pendulous support which is borne at its other end in a hinged and non-displaceable fashion on the packaging machine or its frame. The bearing point of the pendulous support fixed to the frame is preferentially disposed directly below or above the input belt so that the pivot motion of the pendulous support occurs substantially in the longitudinal central plane of the input belt.

The two pendulous support bearings should be displaced relative to each other in the direction of the hopper shaft for all adjustment positions so that adjustment always leads to a monotonic upward or downward motion.

In order to adjust the transfer device as well as the hopper shaft, a support member carrying the hopper shaft is preferentially borne for adjustment via the second adjustment device on a base member supporting the transfer device, and the first bearing of the input belt is disposed on the support member. In this fashion, the first adjustment device can impose a linear vertical adjustment motion on the base member, whereas the second adjustment device can impose a linear adjustment motion on the support member in a direction parallel to the plane of the lowermost folded box of the stack disposed in the hopper shaft.

Further details and features of the invention can be extracted from the following description of an embodiment with reference to the drawing.

DESCRIPTION OF THE PREFERRED EMBODIMENT

Figure 1:
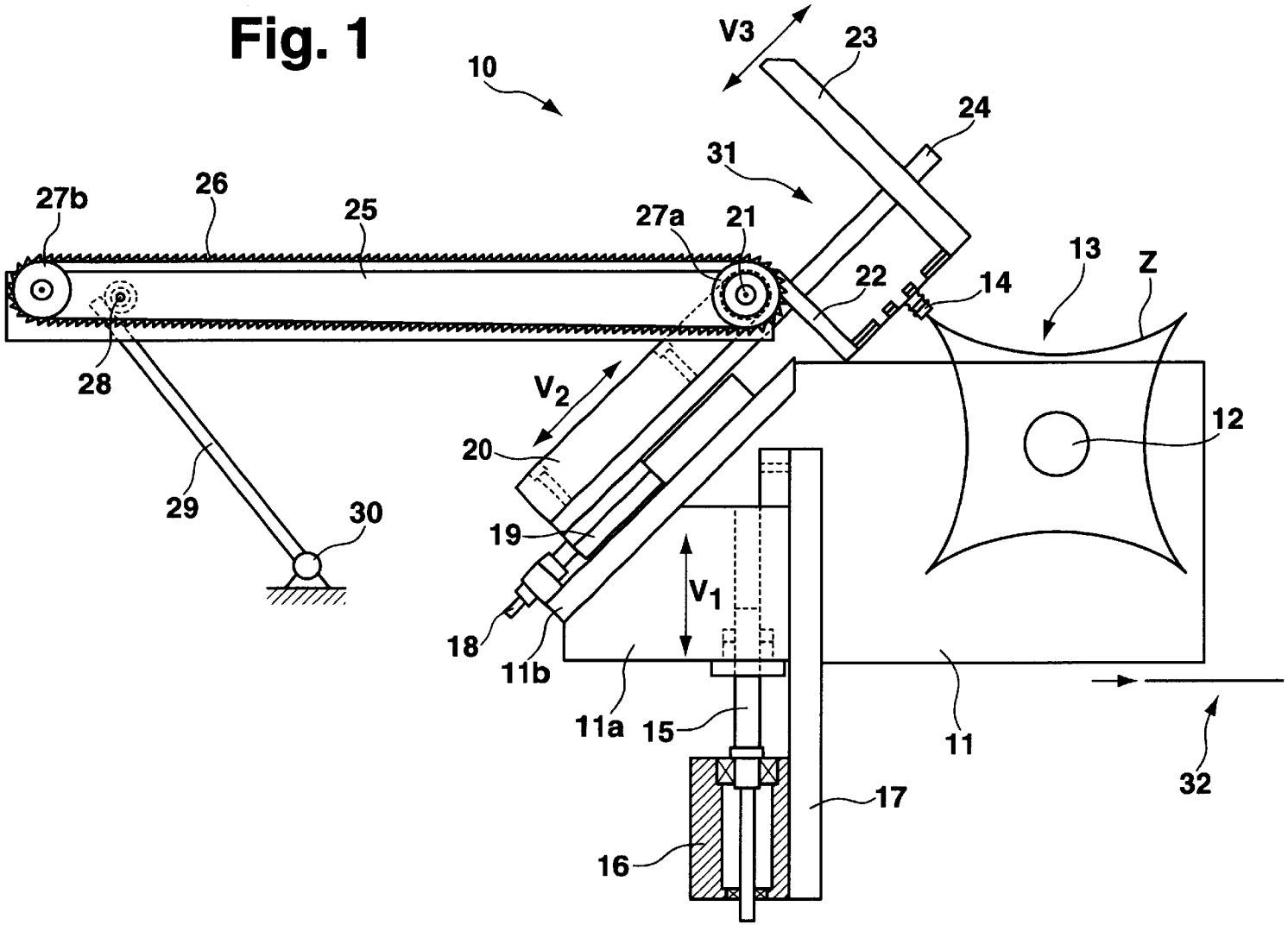
FIG. 1 shows a schematic side view of a folded box hopper in accordance with the invention in a first position.

A folded box hopper 10 shown in FIG. 1 has a bearing block 16 rigidly mounted in a packaging machine and bearing a vertical adjusting spindle 15 which engages an intermediate member 11*a* in such a fashion that it can be vertically adjusted up and down along a guide 17 as indicated by the double arrow $V_1$.

A base member 11 is mounted to the intermediate member 11*a* and has a transfer device 13 (only schematically shown) mounted thereto. The transfer device 13 has a gripper 14 which travels in a vertical plane coincident with or parallel to the plane of the drawing, wherein the gripper 14 moves through a hypocyloid path Z having four points of inflection, as is conventionally produced using planetary gears.

In addition, a base 11*b* is firmly mounted to the base member 11 as well as to the intermediate member 11*a* and bears an adjusting spindle 18 for rotation which, in turn, cooperates with an engagement member 19 fashioned on a support member 20. A hopper shaft 31, which is formed from two separated side walls 22 and 23 and which can accept a stack of folded boxes, is connected to the upper end of the support member 20. The side walls 22 and 23 have a separation which can be changed via a transverse brace 24, as indicated with the double arrow $V_3$.

As shown in FIG. 1, the hopper shaft 31 extends downwardly in a diagonal manner at an angle of approximately 45°, wherein the adjusting spindle 18 accordingly extends diagonally in an upward direction parallel to the plane passing through the lowermost folded box of the stack located in the hopper shaft 31. As indicated by double arrow $V_2$, activation of the adjusting spindle 18 can cause adjusting motion of the support member 20 and thereby of the hopper shaft 31 in an upward or downwardly direction in the plane of the drawing, relative to the base member 11.

In the upper left point of inflection of the hypocycloid path Z, the gripper 14 seats on and grasps the lowermost folded box of the stack located in the hopper shaft 31 to remove it from the hopper shaft 31. The folded box is erected during travel through the hypocycloid path Z in a manner not shown and is dispensed onto a downstream transport device, preferably a folded box chain 32, at the opposite lower right point of inflection in accordance with FIG. 1. When the adjusting spindle 15 is activated, the intermediate member 11*a*, together with the base member 11 and the transfer device 13 borne thereby as well as the base 11*b*, the support member 20 and the hopper shaft 31 can be moved vertically relative to the folded box chain 32.

A support frame 25 of an input belt 26 is hinged to the upper region of the support member 20 proximate the hopper shaft 31 via a first bearing 21. The input belt 26 is an endless circulating toothed belt which travels substantially in the plane of the drawing via two toothed belt wheels 27*a* and 28*b* disposed at the ends. The bearing member 25 is connected to the upper end of a pendulous support 29 via a second pivot bearing 28 proximate its rear end facing away from the hopper shaft 31, wherein the lower end of the pendulous support 29 is mounted to the frame of the packaging machine at its lower end via a pivot bearing 30. The lower bearing 30 is disposed below the input belt 26 and is displaced relative to the upper second bearing 28 in a direction towards the hopper shaft 31, so that the pendulous support 29 constrains the second upper bearing 28 to travel about the lower bearing 30 through a circular arc in the plane of the drawing.

The input belt 27 can feed and stack folded boxes lying on the upper part thereof into the hopper shaft 31.

Figure 2:
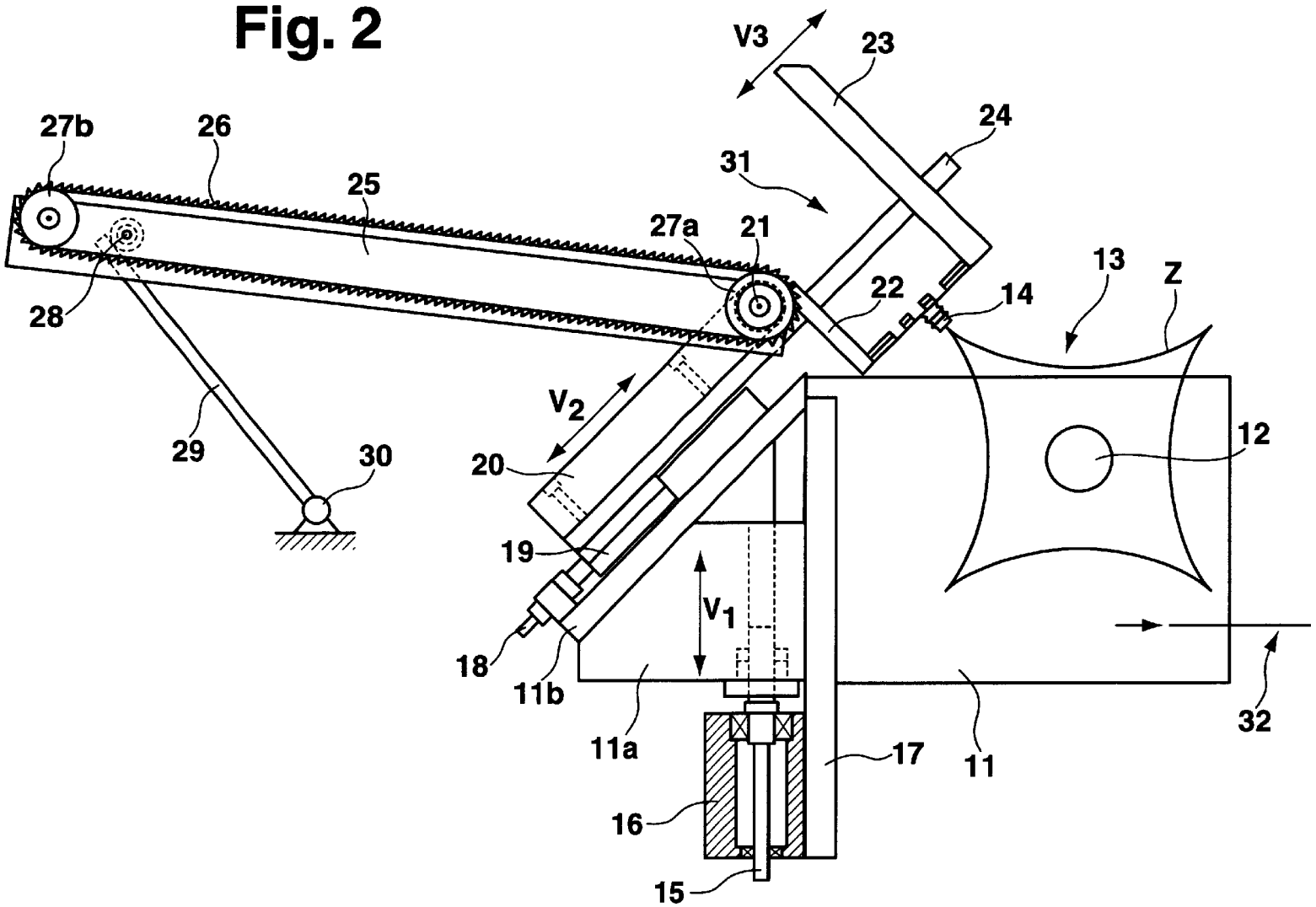
FIG. 2 shows the folded box hopper according to FIG. 1 in a second position.

In the event that the folded box hopper 31 is to be reconfigured for a differing folded box format, the vertical position of the transfer device 13 as well as of the hopper shaft 31 is initially changed relative to the folded box chain 32 using the vertical adjusting spindle 15, constituting a first adjustment device. A changed adjustment is shown in FIG. 2, wherein in the embodiment shown, the transfer device 13 and the hopper shaft 31 have been lowered. An adjustment of the relative position between the gripper 14 at its transfer location, and the lowermost folded box of the stack located in the hopper shaft can simultaneously be effected through activation of the adjusting spindle 18. In addition, the separation between the side walls 22 and 23 of the hopper shaft 31 can be adjusted to the new folded box format. The first bearing 21 of the input belt 26 is shifted due to the adjustment action of the adjusting spindles 15 and 18 leading to a displacement of the rear second bearing 28 along the circular path defined by the pendulous support 29. The position of the input belt 26 which is thereby established is shown in FIG. 2. The front pivot bearing of the input belt 26 disposed on the support member 20 in conjunction with its rear pendulous bearing allow the input belt 26 to automatically follow the adjustment motion defined by the adjusting spindles 15 and 18, without requiring additional adjustment.

We claim:

1. A folded box hopper for accepting a stack of flattened folded boxes in a packaging machine and for transporting folded boxes to a downstream transport belt, the hopper comprising:

a frame;

a hopper shaft having an input opening and an output opening, said hopper shaft for accepting the stack of flattened folded boxes;

a transfer device having a gripper, said gripper communicating with said hopper shaft output opening for removing a lowermost flattened folded box from said hopper shaft, said gripper and said transfer device for depositing folded boxes onto the downstream transport belt;

a first adjustment device mounted to said frame and communicating with said hopper shaft and said transfer device to adjust a height of said gripper and a height of said hopper shaft relative to the downstream transport belt;

a second adjustment device mounted to said first adjustment device and communicating with said hopper shaft to align said hopper shaft relative to said gripper;

an input belt having a front end proximate said hopper shaft input opening for introducing the flattened folded boxes into said hopper shaft, said input belt also having a rear end;

a front bearing means disposed between and cooperating with said front end of said input belt and said hopper shaft to hinge said input belt to said hopper shaft; and a rear bearing means connected between said input belt proximate said rear end thereof and said frame to constrain said input belt to travel through a control path.

2. The folded box hopper of claim 1, wherein said rear bearing means comprises means for hinging said input belt to said rear bearing means, and wherein said control path defines a horizontal and a vertical displacement of said hinging means.

3. The folded box hopper of claim 2, wherein said rear bearing means comprises a pendulous support with a first end having a hinge connection to said frame and with a second end connected to said hinging means.

4. The folded box hopper of claim 3, wherein said hinging means and said hinge connection are displaced relative to each other and relative to said hopper shaft in such a manner that said control path constrains said input belt to smooth, reproducible and reversible travel.

5. The folded box hopper of claim 1, wherein said second adjustment device comprises a support member communicating with said hopper shaft and borne in a displaceable fashion on a base member via a displacement device, said base member also bearing said transfer device, wherein said front bearing means is disposed on said support member.

6. The folded box hopper of claim 5, wherein said first adjustment device imposes a vertical linear adjustment motion on said base member.

7. The folded box hopper of claim 5, wherein said displacement device imposes a linear adjustment motion on said support member in a direction parallel to a plane passing through the lowermost flattened folded box in the stack located in said hopper shaft.

* * * * *